United States Patent [19]

Noorily

[11] Patent Number: 4,711,507

[45] Date of Patent: Dec. 8, 1987

[54] ELECTRICAL CONNECTOR AND LATCHING APPARATUS THEREFOR

[75] Inventor: Peter Noorily, Bridgewater, N.J.

[73] Assignee: Thomas & Betts Corporation, Raritan, N.J.

[21] Appl. No.: 887,664

[22] Filed: Jul. 17, 1986

Related U.S. Application Data

[63] Continuation-in-part of Ser. No. 785,314, Oct. 7, 1985, abandoned.

[51] Int. Cl.[4] ..... H01R 13/639

[52] U.S. Cl. ..... 439/292; 29/869; 439/507; 439/347; 439/557; 439/607

[58] Field of Search ..... 339/91 R, 49 R, 49 B, 339/47 R, 48, 128, 19, 143 R; 29/868, 869

[56] References Cited

U.S. PATENT DOCUMENTS

| | | | |
|---|---|---|---|
| 2,566,993 | 9/1951 | Parsons | 173/328 |
| 2,891,103 | 6/1959 | Swengel | 174/153 |
| 3,146,051 | 8/1964 | Woofter et al. | 339/47 |
| 3,178,674 | 4/1965 | Scheller | 339/217 |
| 3,207,536 | 9/1965 | Lawrence | 285/308 |
| 3,522,963 | 8/1970 | Farnden | 292/83 |
| 3,523,269 | 8/1970 | Witek, Jr. et al. | 339/91 |
| 3,688,243 | 8/1972 | Yamada et al. | 339/49 |
| 3,706,954 | 12/1972 | Krafthefer | 339/17 |
| 3,713,076 | 1/1973 | Gabrielian et al. | 339/91 R |
| 3,885,851 | 5/1975 | Bennett | 339/91 R |
| 4,010,998 | 3/1977 | Tolnar, Jr. et al. | 339/91 |
| 4,078,849 | 3/1978 | Fischer | 339/91 |
| 4,245,879 | 1/1981 | Buck | 339/128 |
| 4,370,013 | 1/1983 | Niitsu et al. | 339/82 |
| 4,448,467 | 5/1984 | Weidler | 339/17 |
| 4,449,767 | 5/1984 | Weidler | 339/17 |
| 4,449,778 | 5/1984 | Lane | 339/143 |
| 4,501,459 | 2/1985 | Chandler et al. | 339/48 |
| 4,508,415 | 4/1985 | Bunnell | 339/143 |
| 4,541,036 | 9/1985 | Landries et al. | 361/426 |

FOREIGN PATENT DOCUMENTS

| | | | |
|---|---|---|---|
| 0026703 | 4/1981 | European Pat. Off. . | |
| 0112713 | 7/1984 | European Pat. Off. . | |
| 2408232 | 6/1979 | France | 339/91 R |

OTHER PUBLICATIONS

Research Disclosure, Jan. 1981, FIGS. 1-4.

Publication (author unknown), No. GA27-3579-1, 5 pages, date unknown.

*Primary Examiner*—John McQuade

*Attorney, Agent, or Firm*—Robert M. Rodrick; Salvatore J. Abbruzzese

[57] ABSTRACT

An electrical connector for particular use in the data communications industry includes an improved latching mechanism for engagement with a like electrical connector or with an apertured panel of a terminal box or the like. The latching mechanism includes a movable arm pivotally mounted integrally with the housing of the connector. The arm comprises a latch on the front end facing the mating end of the connector. A lever captively supported on the housing includes a cam for engagement in a first position with a cam surface on the back portion of the movable arm to dispose the arm in an inclined relation with the latch located closely adjacent the housing so that the latch may be placed for connection another component. When the lever is slid to a second position, a locking spacer thereon engages the front portion of the arm to move the latch away from the housing and cause engagement of the latch with the other component. In the second position, the locking spacer substantially prevents further movement of the latch thereby maintaining the latch in a locking disposition relative to the other component.

32 Claims, 17 Drawing Figures

ELECTRICAL CONNECTOR AND LATCHING APPARATUS THEREFOR

CROSS-REFERENCE TO RELATED APPLICATION

The present application is a continuation-in-part of Ser. No. 785,314, filed on Oct. 7, 1985,now abandoned.

FIELD OF THE INVENTION

The present invention relates to improvements in electrical connectors that are particularly useful in the data communications industry.

BACKGROUND OF THE INVENTION

With the ever increasing use of data communications equipment there is a growing need for electrical connectors for terminating electrical cables thereto and for connecting data equipment or components thereof to each other. Electrical connectors of this type are shown, for example, in U.S. Pat. No. 4,449,778 (issued on May 22, 1984) and U.S. Pat. No. 4,501,459 (issued on Feb. 26, 1985). These connectors include electrical shields for electromagnetic emission protection as well as for electrical and mechanical securement to a metallic braid of an electrically shielded cable. Additionally, these connectors provide for the cable to be able to exit the connector housing in different directions, such as in the axial or orthogonal directions. Another feature shown in these known connectors is the use of shunting or shorting bars to provide a closed-loop connection between selected contact terminals when the connector is in a non-connected condition. Such a feature is intended to protect the equipment from spurious and potentially damaging electrical signals which may be transmitted along a link-line to data equipment, as a result of misconnections or electrical strays.

While those shielded type electrical connectors contain desirable features for data communications applications, they also have some disadvantages. For example, in order to achieve the desired shielding, closed-loop shorting and multiple cable exiting features, these known connectors require complex structure that are difficult to use and assemble, particularly in the field. In addition, the latching mechanism adapted for attachment to equipment panels or to like connectors can result in a disconnection from either the equipment panel or the other electrical connector. In an effort to compensate for this problem, a separate, external wedge is provided for subsequent attachment to the electrical connector in a manner to prevent the latching mechanism from separating in use. Accordingly, while it is advantageous to maintain some of the features of the known connectors, it is also desirable to provide improvements to overcome their various problems.

SUMMARY OF THE INVENTION

It is an object of the present invention to provide an improved electrical connector.

It is another object of the invention to provide an electrical connector having improved latching apparatus.

In accordance with the invention, there is provided an electrical connector for cooperative engagement with a latching portion of an electrical component. The connector includes a housing supporting a plurality of electrical contacts, the housing having a mating end for engagement with the electrical component and an opposing end. Included is a movable arm, integrally supported on the housing, the arm having a latch facing the mating end of the housing and a cam surface facing the opposing end of the housing. The arm is pivotally supported on the housing intermediate the latch and the cam surface such that the latch is movable toward and away from the housing. A cam actuator is supported on the housing and is movable from a first position to a second position. The cam actuator includes cam means thereon engaging the arm cam surface when the actuator is in the first position whereby the latch is in a non-locking relation with the latching portion of the electrical component. The actuator includes spacer means thereon for pivotally moving the latch relative to the housing mating end during movement of the actuator to the second position. The spacer means substantially prevents movement of the latch when the actuator is in the second position to thereby hold the latch in a locking relation with the latching portion of the electrical component.

DETAILED DESCRIPTION OF THE PREFERRED EMBODIMENTS

Figure 1:
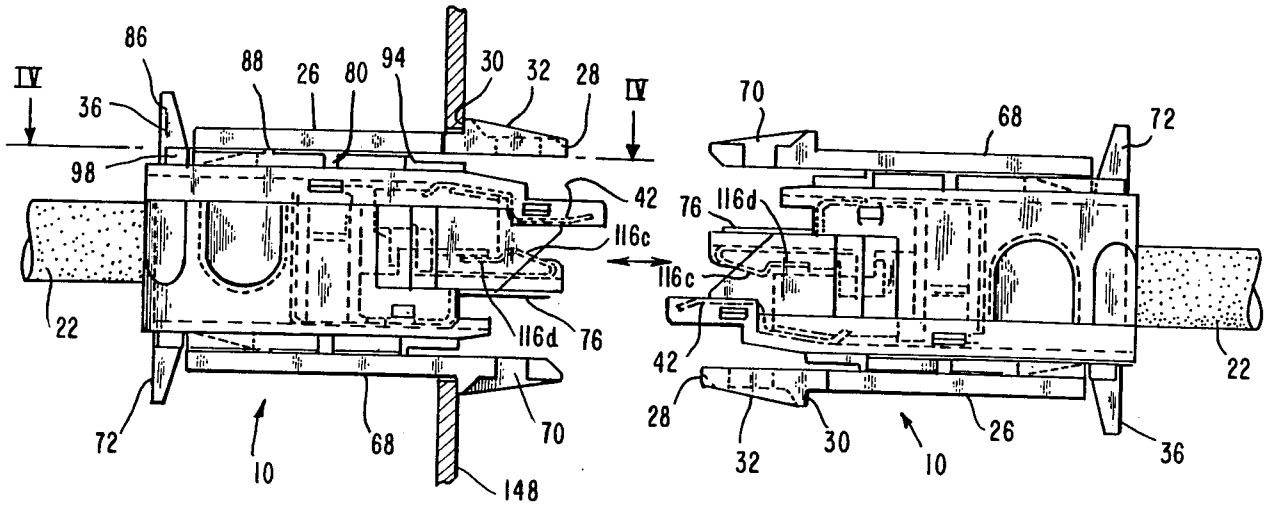
FIG. 1 is a side elevation view, partly in section, of two improved electrical connectors, one of which is shown in latched relation to a panel of an electrical component and the other in alignment for connection to the one connector.

Referring now to the drawing, there is shown in FIG. 1, a pair of electrical connectors disposed to be mechanically latched and electrically connected. Each connector generally designated by reference numeral 10 is of hermophroditic construction and is identical to the other. To effect connection of the pair of connectors, one of theconnectors 10 is rotated about its central axis 180° relative to the other. As the connectors 10 are of identical construction, only the details of one of the connectors will be described hereinafter.

Figure 2:
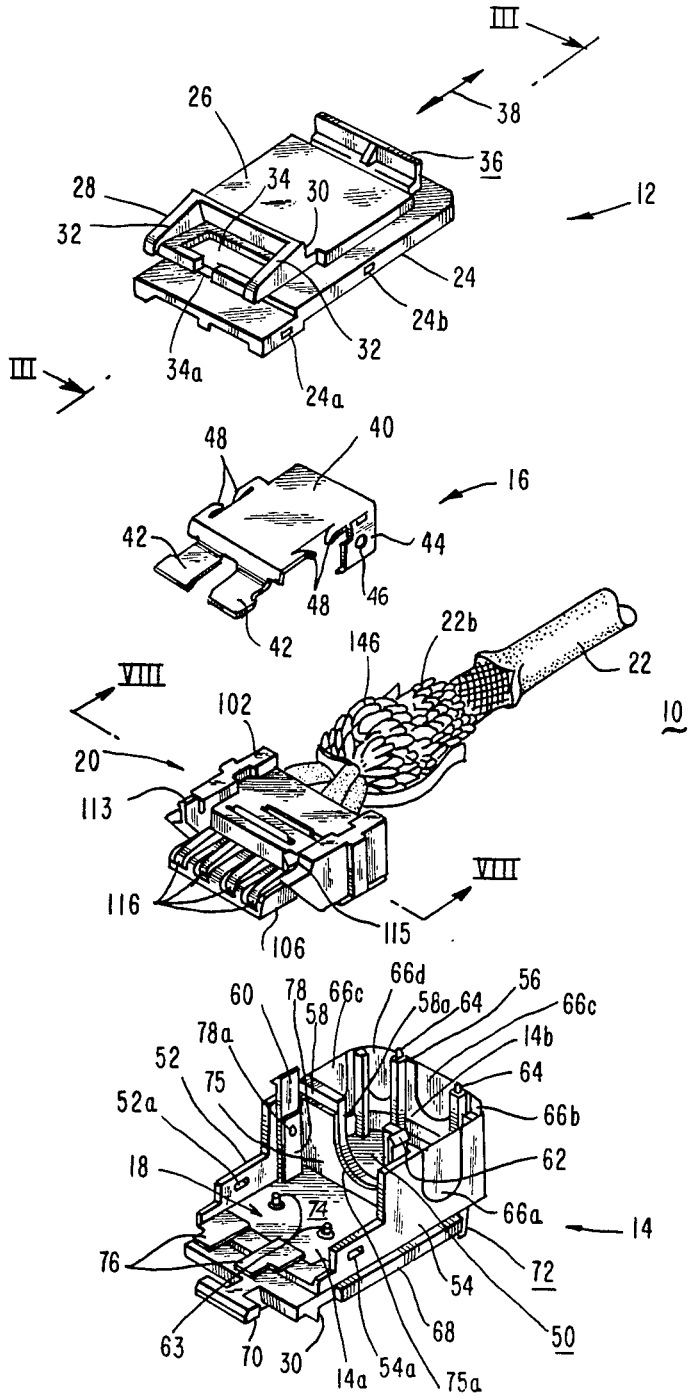
FIG. 2 is an exploded, perspective view of an electrical connector in accordance with the present invention.

Turning now to FIG. 2, the connector 10 comprises an insulative housing including a cover 12 and a base 14, an upper electrically conductive shield 16, a lower electrically conductive shield 18 (shown in assembly with the base 14) and a cable termination sub-assembly 20, shown terminated to an electrical cable 22.

Cover 12 includes an elongate, generally planar lid 24 and a relatively rigid, deflectable arm 26, pivotally mounted on the lid 24. The lid 24 and the arm 26 secured thereto are preferably formed integrally from plastic material. Toward the mating end of the cover 12, the arm 26 includes a latch portion 28 comprising a shoulder 30 facing toward the rear of the arm 26 and a pair of surfaces 32 sloping downwardly toward the front mating end of the arm 26. Disposed between sloping surfaces 32 is a latch opening 34, generally C-shaped and having a front throat **34*a*, the opening 34 and throat 34*a* adapted to receive a complementary T-bar latch located on the base of another like connector, as will be described. A separate, preferably plastic lever 36 is captively contained in the cover 12, the lever 36 being disposed between the lid 24 and the arm 26 for slidable movement in the longitudinal direction as indicated by arrow 38 in FIG. 2 in manner, as will be detailed below, to effect locking and un-locking relation with another like electrical connector. Openings 24*a* and 24*b* are provided in both of the side walls of the lid 24** for cooperatively retaining the connector components in joined relation as will be set forth.

Upper shield 16, formed preferably by stamping a flat strip of metal, comprises a generally flat portion 40 and a pair of tongues 42 projecting outwardly from the portion 40 in an offset plane substantially parallel therewith. A pair of tabs 44 (only one of which can be seen in FIG. 2) depend downwardly from the flat portion 40 and substantially orthogonal thereto. Disposed on each of the tabs 44 is a protuberance 46 serving as a means for providing electrical engagement with the lower shield 18. On each side of the flat portion 40 there are downwardly projecting, resilient tines 48 defining a means for securing the shield 16 to a post (not shown) projecting from the undersurface of the lid 24.

Base 14 comprises a floor 50 from which upstanding, transversely spaced sidewalls 52, 54 and rear wall 56 extend. Disposed transversely across the width of the base 14 is a partition 58 having an open slot **58*a* formed therein approximately centrally between the sidewalls 52 and 54. The partition defines generally a front compartment 14*a* adjacent the front, mating end of the base 14 and a rear compartment 14*b* adjacent the rear end of the base 14. Projecting upwardly from the floor 50 adjacent the respective side walls 52, 54 are locking tabs 60, 62 for resilient locking engagement with the openings 24b in the cover lid 24. Projecting upwardly from the rear wall 56 are further tabs 64 for additional engagement with the cover lid 24. Projecting upwardly from the floor 50 in front compartment 14*a* are a pair of posts 63 that are arranged to enter openings (now shown) in the underside of the cable termination sub-assembly 20, so as to provide a means of maintaining the position of the sub-assembly 20 relative to the base 14 in assembly. Openings 52*a* and 54*a* are provided in the respective side walls for engagement with locking elements in the termination sub-assembly 20**.

Disposed around the rear compartment **14*b* are replacedly removable gates 66*a*–66*e*. Gates 66*a*–66*e* are preferably slidably mounted in the base walls and provide accessible ports at five different locations for exiting of the electrical cable, as will be described. The ports are located to permit cable exiting in the axial direction (66*c*), orthogonal directions (66*a* and 66*e*) and in the 45° directions (66*b* and 66*d***). Although five ports are shown, it should be understood that any suitable number of accessible ports may be provided. In addition, while it is preferably to have slidable gates defining such accessible cable ports, it should be appreciated that other accessible ports such as conventional knock-outs may also be employed.

Still referring to FIG. 2 and also to FIG. 1, the base 14 includes a relatively rigid, deflectable arm 68, similar to arm 26 in the cover. Arm 68 is pivotally mounted on the bottom surface of base floor 50. Toward the mating, front end of base 14, there is a projecting latch 70 in the form of a T-bar for complementary engagement with the latch portion 28 of the cover 12 of another identical connector. A separate, sliding lever 72 is captively contained in the base 14, the lever 72 being mounted between the deflectable arm 68 and the floor 50 of the base 14. The base 14, except for the removable gates **66*a*–66*e* and the lever 72 is preferably, integrally formed of plastic material. The gates 66*a*–66*e* are preferably formed of plastic as an integral member interconnected by severable webs for ease of fabrication and assembly. The lever 72** is also preferably formed of plastic.

The lower shield 18 is formed preferably by stamping from a sheet of flat metal. The shield 18 comprises a generally flat portion 74 from which a pair of tongues 76 project substantially parallel to and offset from the flat portion 74. Upwardly extending tabs 78 project substantially orthogonally from the shield flat portion 74, one tab 78 being disposed adjacent to each of the locking tabs 60 and 62 of the base 14. An opening **78*a* is disposed in each of the tabs 78 for receipt and engagement with the protuberance 46 on the upper shield 16, such that upon assembly of the connector 10, the upper shield 16 and the lower shield 18 are in electrical connection. The lower shield 18 has suitable openings in the flat portion 74 to spacedly receive the posts 63 on the base floot 50, such that the posts 63 may extend upwardly therethrough. The shield 18 further includes an upstanding wall 75 disposed against base partitions 58, the shield wall 75 having an open slot 75*a* formed therein in registry with partition slot 58*a*. Slot 75*a* has a dimension approximately equal to the dimension of slot 58*a*. The shield slot 75*a* and wall 75** serve as a means of electrically connecting a braided shield of an electrical cable and as a strain relief means for the cable.

Figure 4:
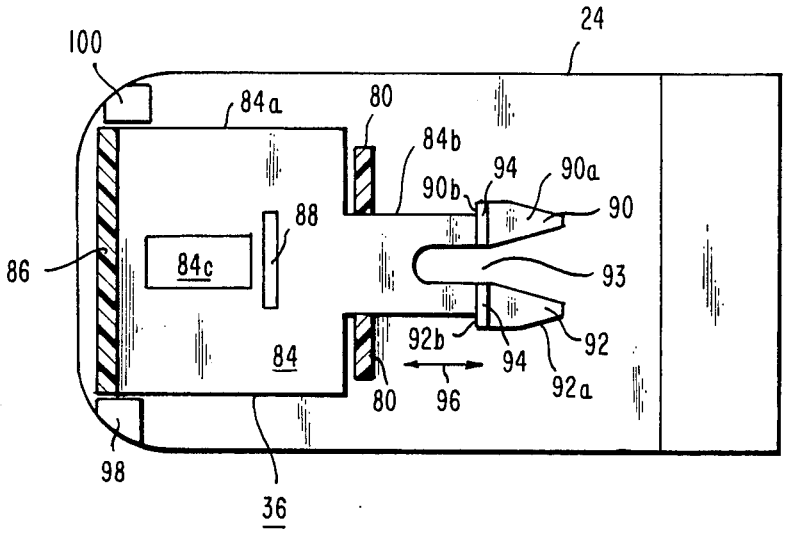
FIG. 4 is a cross-sectional view as seen along viewing lines IV—IV of FIG. 1.
Figure 3:
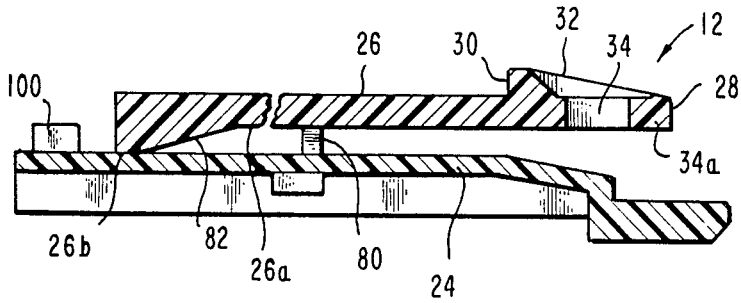
FIG. 3 is a cross-sectional view of the connector cover as seen along viewing lines III—III of FIG. 2, with the sliding lever being eliminated to facilitate the description thereof.

By reference now to FIGS. 3 and 4, the details of the connector latching mechanism and the sliding levers on the cover and base may be more fully understood. The sliding levers on the cover and base are preferably identical in construction and function, so that by describing the lever 36 on the cover 12, it will be appreciated that these details also apply to the lever 72 on the base 14. FIG. 3 illustrates the cover 12 in cross-section, absent the lever 36. The deflectable arm 26 is attached to the cover lid 24 by a flexible web 80 such that the arm 26 is upwardly spaced from and pivotably movable on the lid 24. In the present form, the web is provided in two portions that are spaced transversely in the cover 12, defining an opening therebetween. The arm 26 includes adjacent an end facing the rearward end of the cover 12 a cam surface 82 sloping downwardly from the arm bottom surface 26*a* toward the rear end of the cover 12. The web 80 is disposed intermediate the cam surface 82 and the latch portion 28 so that the latch portion and cam surface 82 can pivot thereabout.

With further reference to FIG. 1 and also now to FIG. 4, the lever 36 comprises a generally flat actuator plate 84 having a rear portion 84*a* and a narrower front portion 84*b*. At the rear portion of the plate 84, there is an upstanding handle 86 (FIG. 1) adapted to be manually grasped by the connector user. Also at the rear portion 84*a*, there is an opening 84*c* extending through the plate 84 and disposed at a location such that a bottom portion 26b of the arm 26 (FIG. 3) including the cam surface 82 may reside therein when the lever 36 is in the position shown in FIGS. 1 and 4, the arm bottom portion 26*b* contacting the upper surface of the lid 24. Adjacent the opening 84*c* on the rear portion 84*a* is an upstanding wall 88 serving as a cam for engaging the arm cam surface 82. At the distal end of the front portion 84*b*, there are a pair of defelectable tines 90 and 92 defined by a slot 93 extending therebetween. The slot 93 permits resilient deflection of the tines 90, 92 laterally toward each other. The front surfaces 90*a* and 92*a* of the tines are tapered to permit entry of the lever front portion 84*b* between the two transversely spaced portions of the web 80 on the cover. Upon insertion of the front portion 84*b* between the spaced webs 80, the tines 90 and 92 will deflect, upon engagement with the webs 80. Upon continued insertion and once passed the webs 80, the tines 90 and 92 will spring outwardly back, thereby captivating the lever 36 as the webs 80 are disposed between the lever rear portion 84*b* and the rearwardly facing shoulders 90*b* and 92*b* on the tines. Also located on the front portion 84*b* spacedly on each tine 90 and 92 is another upwardly extending wall 94 serving as a locking spacer for engaging the lower surface 26*a* of the arm 26. It should be noted that as captivated in the cover between the lid 24 and the arm 26, the lever 36 is slidably movable in the direction as shown by the arrow 96. Thus, the cam 88 is movable between the cam surface 82 and the web 80, while the spacer 94 is movable between the web 80 and the latch portion 28. Located on the upper surface of the cover lid 24 is a pair of transversely spaced bosses 98 and 100 for maintaining the lever 36 in a relatively straight line during its sliding inward and the outward movement on the cover 12.

Figure 5:
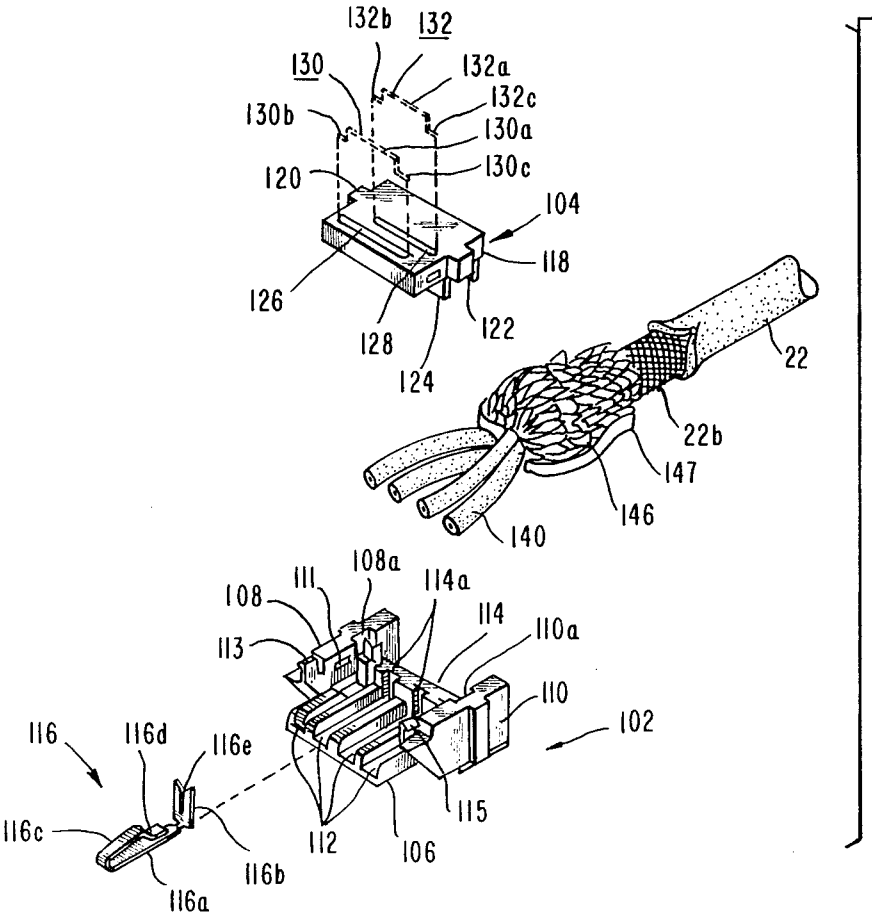
FIG. 5 is an exploded, perspective view of the connector cable termination sub-assembly, showing a shielded, electrical cable in position for termination thereto.

Referring again to FIG. 2 and also now to FIG. 5, the details of the cable termination sub-assembly 20 are described. The sub-assembly 20 comprises an electrically insulative contact holder 102 and an electrically insulative conductor holding block 104. Holder 102, peferably formed of a molded plastic material, comprises a bottom wall 106 and two transversely spaced, upstanding sidewalls 108 and 110. A plurality of spaced, substantially parallel channels 112 are provided in the bottom wall 106. Sidewalls 108 and 110 each have a recess 108*a* and 110*a* formed in their interior surfaces. A transverse wall 114 of height less than the sidewalls extends across the bottom wall 106 and has slots 114*a* provided therein. Upwardly extending latching elements 113 and 115 are provided on the sidewalls for retentive coupling with openings 24*a* in the cover lid 24 when the connector is assembled. In addition, openings 111 (only one of which can be seen in FIG. 5) are provided in the interior surface of each of the sidewalls for retentive engagement with the conductor holding block 104.

A plurality of electrical contacts 116 are supported by the holder 102. The contacts 116 are formed of a suitable conductive material, such as phosphor bronze, and comprise a generally elongate base portion 116*a*, an insulation displacement contact (IDC) portion 116*b*, a folded-over, resiliently deflectable tongue portion 116*c* and an offset flat portion 116*d* disposed at the distal, free end of the folded-over-tongue portion 116*c*. The IDC portion 116*b* is of conventional, generally flat, blade-type configuration having two relatively sharp tines with a cable conductor receiving slot 116*e* provided therebetween. The contacts 116 are fixedly secured in the holder 102 with the contact base portions 116*a* each residing in a respective channel and an IDC portion 116*b* residing in a respective slot 114*a*, the IDC portions projecting above the top surface of transervse wall 114. While in the preferred arrangement there are four contacts 116 shown, it should be appreciated that any suitable number of contacts may be used.

Figure 6:
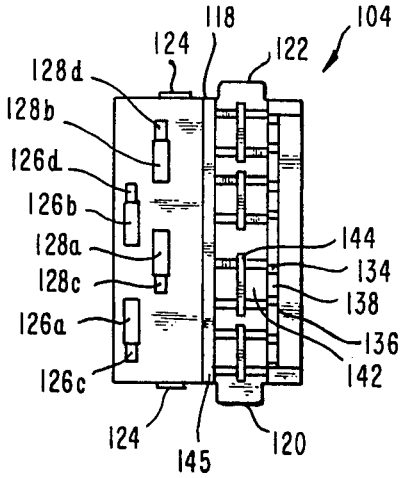
FIG. 6 is a bottom plan view of the sub-assembly conductor holding block.

Still referring to FIGS. 2 and 5, the conductor holding block 104 comprises a generally flat body 118, preferably of molded plastic, with a pair of ribs 120 and 122 extending from two opposite ends thereof, ribs 120 and 122 adapted to be received in the slots 108*a* and 110*a* of the contact holder 102. Also, adjacent ribs 120, 122 on each end of the body 118 is a latching ledge 124 for resilient receipt into the openings 111 of the holder 102. Extending across the body 118 between the opposite ends thereof is a pair of spaced, elongate slots 126 and 128, each slot being of approximately the same length but offset relative to the other and extending only partially into the upper surface of body 118. As shown in FIG. 6, at each longitudinal end of each slot there is an opening extending through the body 118, the openings being designated as 126*a*, 126*b* and 128*a*, 128*b*. Recesses communicating with the openings and extending only partially into the bottom surface of the body 118 are provided, the recesses being designated as 126*c*, 126*d* and 128*c*, 128*d*.

As illustrated in FIG. 5, a pair of shorting bars 130 and 132 are provided for retentive support in the block 104. The bars each comprise an elongate shaft 130*a* and 132*a* and a pair of extending terminals 130*b*, 130*c* and 132*b*, 132*c*, the terminals being formed as feet, extending in the same axial direction, but offset from and substantially parallel to the bar shafts. In the holding block 104, the bars 130 and 132 are supported such that the shafts 130*a* and 132*a* reside in the upper slots 126 and 128, respectively and the terminals 130*b*, 130*c* and 132*b*, 132*c* extend through openings 126*a*, 126*b* and 128*a*, 128*b* and reside in lower body surface recesses 126*c*, 126*d* and 128*c*, 128*d*, respectively. As the shorting bars 130 and 132, the function of which will be explained, are contained with their shafts and terminals in slots and recesses with the body insulation in substantial surrounding relation, these bars are supported in the block 104 with minimum exposure. The shorting bars 130 and 132 are preferably made of phosphor bronze wire, but any suitable metal may be used.

Referring again to FIG. 6, the bottom of the conductor holding block 104 comprises a plurality of conductor retainers, one for each cable conductor to be terminated to an IDC portion 116*b* on the contact holder 102. In the holding block 104 being described, there are four such retainers, each of substantially identical construction. The retainer includes a pair of spaced walls 134 and 136 defining a slot 138 therebetween. Slot 138 is of dimension to frictionally receive and hold an insulated conductor 140 (FIG. 5) therein. Adjacent the walls 134 and 136 and communicating with the slot 138 is a cradle 142, bisected by a deeper groove 144. The groove 144 is adapted to freely receive the IDC portion 116*b* of the electrical contacts 116 upon insulation displacement termination with the insulated conductor 140, the bottom walls of the cradle 142 providing support on either side of the conductor during termination. A back wall 145 provides a mechanical stop for the conductors 140 upon being dressed into the slot 138, the abutment of the free conductor end theregainst providing assurance that the conductor traverses the groove 144 that is to receive the IDC portion of the electrical contact.

Figure 7:
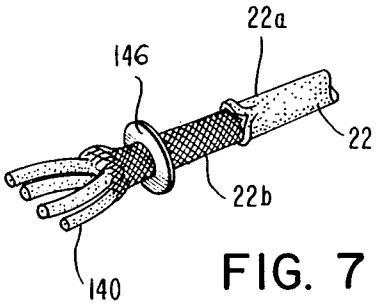
FIG. 7 is a perspective view of a shielded, electrical cable in preparation for termination in the connector cable termination sub-assembly.
Figure 8:
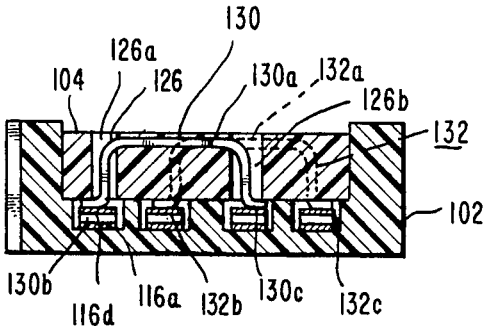
FIG. 8 is a cross-sectional view of the connector cable termination sub-assembly as seen along lines VIII—VIII of FIG. 2 and showing details in phantom for purposes of illustration and description.

In terminating an electrical cable 22 preferably of the shielded type and assembling the connector 10, the cable 22 is prepared, as shown in FIG. 7 by peeling back the outer cable insulative jacket 22*a*, exposing an extent a shielding braid 22*b* and exposing the insulated conductors 140. A flat metal washer 146 is slid over the braid 22*b* and, as shown in FIG. 5, the braid 22*b* is folded back over the washer 146. Aluminized insulation 147 that may surround each pair of conductors 140, for example, is peeled back and removed from cable 22. The conductors 140 are retentively dressed in the respective slots 138 in the bottom of the holding block 104 and the contact holder 102 is then joined with the block 104. Upon joining the holder 102 and the block 104, the IDC portions 116*b* of the contacts, displace the insulation around the conductors 140 and make electrical engagement with conductors therein, the IDC portions being accommodated in the block grooves 144. In addition, the shorting bars 130 and 132 are in engagement with the electrical contacts 116. As illustrated in FIG. 8, the terminal 130*b* is shown contacting the leftward-most electrical contact at its contact at its flat, deflectable portion 116*d* while terminal 130*c* is contacting the third contact from the left. Similarly, as shown in phantom, terminal 132*b* contacts the second contact from the left, while terminal 132*c* contacts the fourth contacts from the left. As such, through shorting bar 130 the first and third contacts are in electrically common connection and the second and fourth contacts are in electrically common connection. The second contact is bridged by the axial shaft 130*a*, while the third contact is bridged by the axial shaft 132*a*. In this manner, the first and third cable conductors, for example are releasably maintained in a closed-loop condition and the second and fourth cable conductors are also releasably maintained in a closed-loop condition in the termination sub-assembly 20 as will be explained.

Figure 9B:
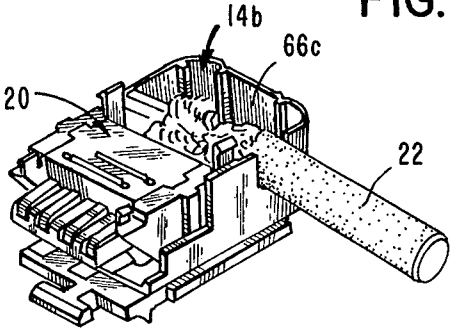
FIGS. 9*a*, ]*b*, and 9*c* are perspective views of the electrical connector in partial assembly, showing the capability of the connector for different cable exiting directions.
Figure 9A:
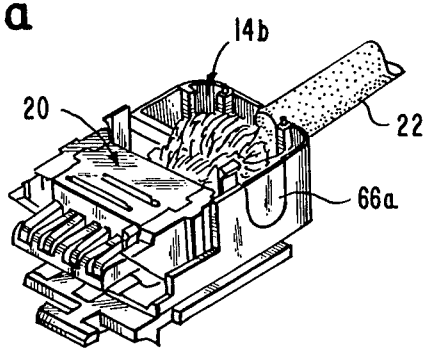
Figure 9C:
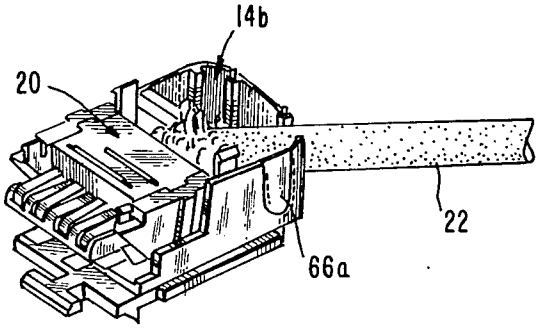

Referring now again to FIG. 2, the cable termination sub-asembly 20 with cable 22 terminated thereto is then joined to the base 14 with the shield 18 assembled thereon. One of the gates to the accessible cable ports is removed depending upon which direction the cable 22 is to exit. For example, if the cable is to exit in the axial direction (see FIG. 9*a*) then gate 66*c* will be removed. Similarly, for cable exiting at the orthogonal direction (FIG. 9*b*), gates 66*a* or 66*e* will be removed or for cbale existing at the 45° direction (FIG. 9*c*), gates 66*b* or 66*d* will be removed. In joining the sub-assembly 20 to the shielded base 14, the washer 146 on the cable 22 is disposed in the front compartment 14*a*, with the folded-back braid 22*b* extending through the shield wall opening 75*a* and the partition opening 58*a*. Pulling the cable axially from the rear causes the washer 146 to compress the shielding braid 22*b* against the shield wall 75, transferring the pulling stresses to the braid 22*b* and thereby providing cable strain relief without radially compressing the cable 22. Engagement of the braid 22*b* with the shield wall 75 also provides a common electrical connection between the shield 18 and the cable shielding braid 22*b*. It can also be seen by reference to FIGS. 9*a*–9*c*, that compartment 14*b* is sized to accommodate bending of the electrical cable from the strain relief loction at the shield wall opening 75*a* to any of the selected ports. Furthermore, as the cable braid 22*b* electrically engages the shield wall 75 at the same interior strain relief location in the base 14 for cables exiting in any of the available directions, the compartment 14*b*, in the preferred embodiment, does not require shielding.

In joining the cable termination sub-assembly 20 to the base 14, the latching elements 113 and 115 on the sub-assembly 20 are engaged with the base openings, 52*a* and 54*b* for securement therein. The cover 12, with the upper shield 16 attached thereto by tines 48 is then assembled to complete the connector 10. During assembly of the shielded cover to the shielded base, the protuberances 46 on tabs 44 engage the openings 78*a* in the lower shield tabs 78. As such, the upper shield 16 and the lower shield 18 are in electrically common connection.

As depicted in FIG. 1, the connectors 10 are constructed to be electrically and mechanically joined together and attached to a wall panel 148 or the like. Prior to assembling the pair of connectors 10, as described hereinabove with reference to FIG. 8, alternating conductors, namely conductors one and three are terminated in a closed-loop condition through shorting bar 130. Similarly, conductors two and four are terminated in a closed-loop condition through shorting bar 132. Thus, when a connector 10 with terminated cable 22 is assembled, the closed-loop conditions prevent inadvertent shorting of pairs of conductors which could, by transmission of spurious signals, cause loss of data in equipment to which the cables are conducted. When a pair of connectors 10 as described herein are connected to each other, the folded over tongue portions 116*c* of the electrical contacts of opposing connectors engage each other and deflect thereby causing the contact flat portions 116*d* to be displaceably moved away from engagement with the shorting bar terminals 130*b*, 130*c* and 132*b*, 132*c*. The common connections between conductors one and three and between conductors two and four are thereby broken, permitting each conductor to be electrically connected individually to a conductor of the other connector. Also during connection of the connectors 10, the projecting tongues 42 of the upper shield on one connector engage the projecting tongues 76 of the lower shield of the inverted, other connector, thereby establishing electrical connection between the shields of the two electrical connectors.

Figure 10A:
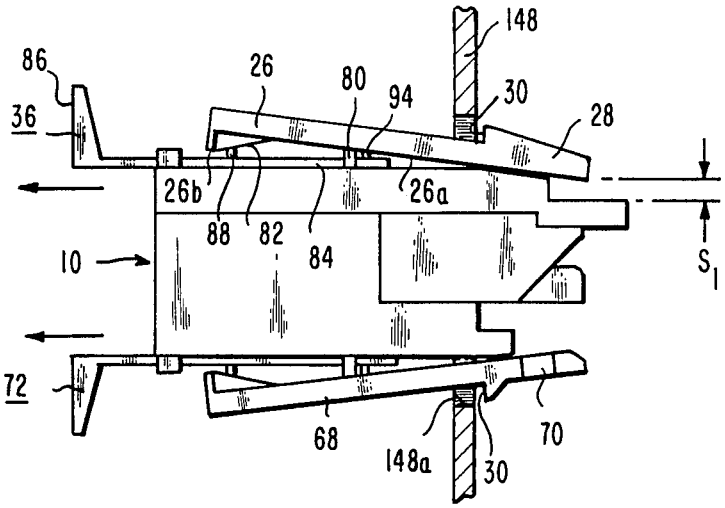
FIGS. 10*a* and 10*b* are schematic side elevational views of the connector, illustrating the operation of the connector latching mechansim for attachment to a panel of an electrical component.
Figure 10B:
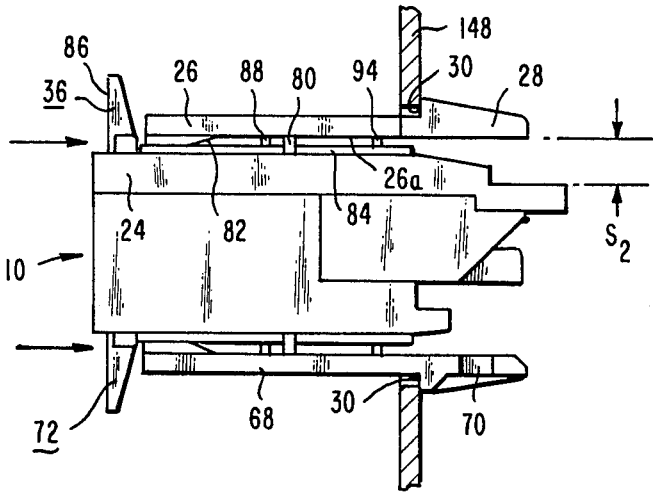

Mechanical latching and unlatching of the electrical connectors 10 to panel 148 of an electrical component, such as the wall of a data terminal are described with reference to the schematic representations shown in FIGS. 10*a* and 10*b* and to other like connectors by reference to FIGS. 10*c* and 10*d*. In FIG. 10*a*, the connectors 10 are in an unlatched condition relative to the panel 148. In this condition, the slidable levers 36 and 72 are in a first position wherein they have been pulled axially away from the connector housing. In this position, the cam 88 on the actuator plate 84 is in engagement with the cam surface 82 on the arm 26. The spacer 94, in this position is adjacent the webs 80 and the latch portion 28 has been pivoted toward the connector housing. The arm 26 is thus disposed in an inclined position, pointing generally downwardly toward the connector mating front end. The front end of the latch portion 28 is spaced a distance $S_1$, relative to the front of the lid 24. The T-bar latch 70 on the base arm 68 has been likewise moved by lever 72 to a position similar to the latch portion 28. In this condition, the front end of the connector 10, shown on the left in FIG. 10*a*, may be readily inserted through a clearance opening 148*a* in the panel 148 until the shoulders 30 on latch portion 28 and T-bar latch 70 pass through. The levers 36 and 72 are then moved, as indicated in FIG. 10*b* axially toward the connector housing to a second position. During this movement, the cam 88 slides off the cam surface 82 and toward webs 80. The spacer 94 moves toward the latch portion 28 engaging the arm undersurface 26*a* and thus pivoting the latch portion 28 upward away from the connector to a generally horizontal position. In this second position, the arm is generally parallel to the lid 24 and the front end of the latch portion 28 is spaced a distance $S_2$ relative to the front of the lid 24, the spacing $S_2$ being greater than the spacing $S_1$. The upward movement of the arm 26 causes the shoulder 30 to engage the panel 148, providing a mechanical latch thereto. Locking is effected in the second position inasmuch as the spacer 94, positioned away from the flexible webs 80 and toward the latch portion 28, serves as a stop substantially preventing movement of the latch portion 28 toward the connector housing, and the arm bottom portion 26*b*, contacting the upper surface of the lid 24 through the opening 84*c* (FIG. 4) of the lower 36, substantially prevents downward movement of the rear portion of the arm 26. Inward movement of the lever 72 similarly moves arm 68 and locks the arm 68 to the panel 148.

Figure 10C:
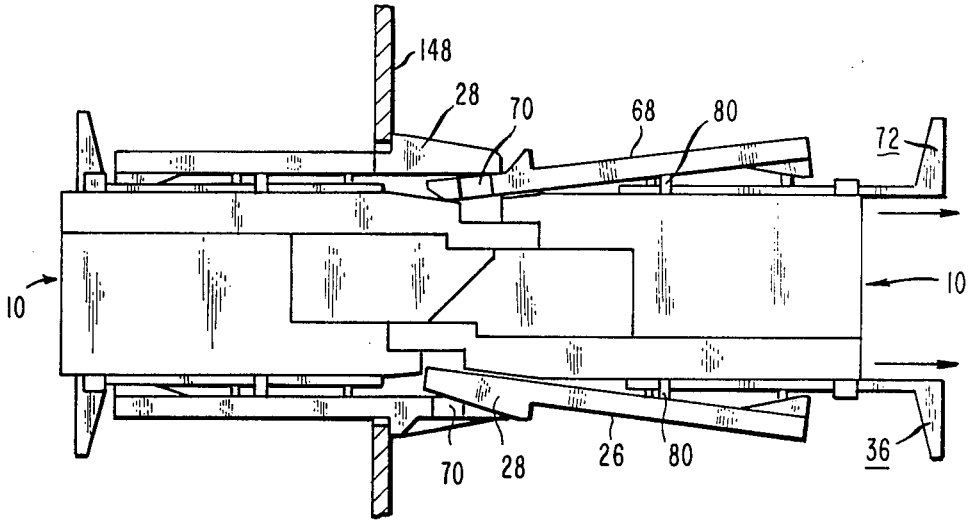
FIGS. 10*c* and 10*d* are schematic, side elevational views of the connector, illustrating the operation of the connector latching mechanism for attachment to a like electrical connector.
Figure 10D:
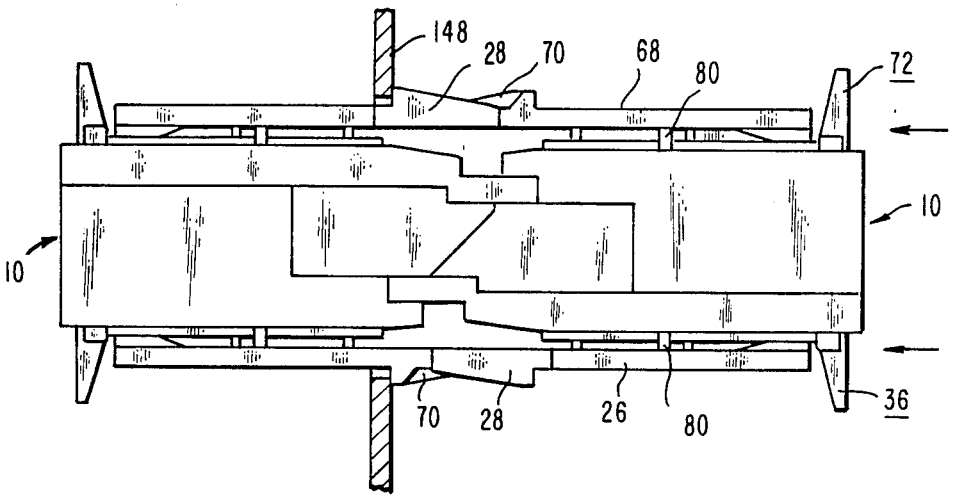

By reference now to FIGS. 10*c* and 10*d*, latching and unlatching of the connectors 10 to each other are shown. For example, connecting the connector (on the right) to another connector (on the left) that has already been latched to a panel 148 of an electrical component, is effectively accomplished in the same manner as the connector was attached to the panel. As such, the levers 36 and 72 are axially pulled out as in FIG. 10*c*, pivotally deflecting the arms 26 and 68 about the webs 80 until the latch portion 28 and T-bar latch 70 are moved substantially transversely toward the connector housing. This permits electrically mating the two connectors in an unlocked relation with the latch portions 28 and the T-bar latches 70 in non-engaged juxtaposition. As shown in FIG. 10*d*, axial movement of the levers 36 and 72 inward toward the connector housing, moves the arms 26 and 68 pivotally into a generally horizontal position and causes latching engagement between the respective T-bar latches 70 into the C-shaped openings of the latch portions 28. Locking is established as the arms 26 and 68 are substantially prevented from movement relative to the connector housings.

Having described the preferred embodiments and improved features of the electrical connector herein, it should be appreciated that variations may be made thereto without departing from the contemplated scope of the invention. For example, while each connector has been described as including two sliding levers in the latching mechanism, it should be appreciated that any suitable number may be used, depending upon the particular applications. Also, the connector may be utilized to receive multiple electrical cables through different ports in the second compartment thereof with conductors from each cable being terminated in the sub-assembly. In this instance, a large washer may be used to commonly surround the cables for engagement with the cable shielding braids and for strain relief.

It should also be understood that while the latching mechanism for the connector described herein utilizes a "push to lock and pull to open" technique, locking and unlocking may be effected with the opposite technique. In this regard, by reference to FIGS. 11*a* and 11*b* there is schematically shown a connector comprising a latching mechanishm that utilizes a "push to open and pull to lock" technique. In this embodiment, connector 210 similar to connector 10 described hereinabove, comprises a cover including a lid 224 and a deflectable arm 226 integrally connected to each other by a flexible web 228. The flexible arm comprises a latching portion 230 at the front or mating end thereof. At the under surface 226*a* of the deflectable arm and disposed between the web 228 and the latching portion 230, there is a downwardly extending, inclined cam surface 232. At the opposite end of the deflectable arm 226 there is a downwardly projecting wall 234 serving as a rear locking spacer.

A sliding lever 236 similar to the lever 36 described hereinabove is captively disposed between the deflectable arm 226 and the lid 224. The lever 236 has an opening 238 within which the flexible web 228 resides, the opening 238 permitting sliding movement of the lever 236 on the lid 224. Lever 236 also includes a recess 240 within which the rear locking spacer 234 rests while the lever 236 is in the "push" or open position as illustrated in FIG. 11*a*.

Lever 236 comprises a cam 242 disposed forward of the opening 238 for engaging the cam surface 232 of the deflectable arm 226. Forwardly spaced from cam 242 and projecting upwardly from the lever 236 is wall 244 which serves as a forward locking spacer. Lever 236 also includes a vertically projecting handle portion 246 for manually grasping the lever to effect locking and unlocking.

Figure 11A:
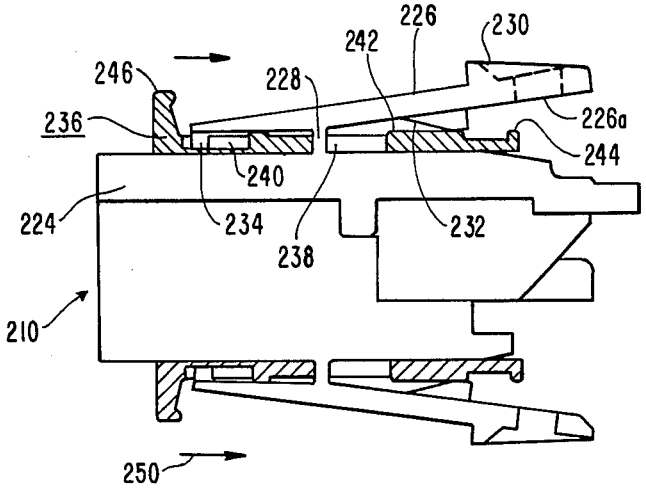
FIGS. 11*a* and 11*b* are schematic side elevation views illustrating another embodiment of the connector latching mechanism.
Figure 11B:
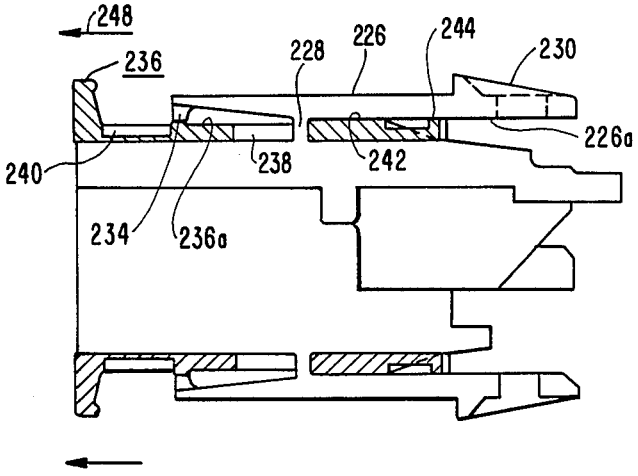

As shown in FIG. 11*a*, the latching mechanism is illustrated in the unlocking position. In this position, the cam 242 on the sliding lever is in engagement with the cam surface 232 of the deflectable arm thereby causing the front latching portion 230 to extend upwardly in an inclined manner. In this position, as the deflectable arm 226 is pivoted about the web 228, the rear wall 234 extends downwardly into the recess 240 in the sliding lever 236. To effect locking, reference is made to FIG. 11*b*. The sliding lever 236 is pulled outwardly in a direction according to arrow 248. As a result of this movement, cam 242 and cam surface 232 on the arm 226 disengage thereby permitting the deflectable arm 226 to pivot such that the front latching portion 230 moves downwardly until the arm 226 is in a substantially horizontal position. In this position, the front locking spacer 244 engages the lower surface 226*a* of the deflectable arm. Similarly, the rear locking spacer 234 has been moved up from the recess 240 to the upper surface 236*a* of the sliding lever 236. At this point of contact, the surface 236*a* may be slightly raised adjacent the recess 240. In this position, both the front locking spacer 244 and the rear locking spacer 234 support the deflectable arm 226 on both sides of the web 228 thereby preventing the deflectable arm 226 from further pivotal movement. Thus, the front latching portion 230 of the connector can be locked to a complimentary latching portion of a mateable connector. To effect unlocking of this connector, the sliding lever 236 is pushed inwardly in the direction of arrow 250 as shown in FIG. 11*a*.

The embodiments described herein are intended to be illustrative and not limiting, the true scope of the invention being set forth in the claims appended hereto.

I claim:

1. An electrical connector for cooperative engagement with a latching portion of an electrical component, comprising:

a plurality of electrical contacts;

a housing supporting said electrical contacts, said housing having a mating end for engagement with said electrical component and an opposing end;

a movable arm integrally supported on said housing, said arm having a latch facing said mating end of said housing and a cam surface facing said opposing end of said housing, said arm being pivotally supported on said housing intermediate said latch and said cam surface such that said latch is movable toward and way from said housing; and a cam actuator supported on said housing and movable from a first position to a second position, said cam actuator including cam means thereon engaging said arm cam surface when said actuator is in said first position whereby said latch is in a non-locking relation with said latching portion of said electrical component, said actuator including spacer means thereon for pivotally moving said latch relative to said housing mating end during movement of actuator to said second position, said spacer means substantially preventing movement of said latch when said actuator is in said second position to thereby hold said latch in a locking relation wtih said latching portion of said electrical component.

2. An electrical connector according to claim 1, wherein said movable arm is integrally supported to said housing by a flexible web, said web providing a space between said arm and said housing.

3. An electrical connector according to claim 2, wherein said cam actuator is disposed between said arm and said housing for sliding movement therein.

4. An electrical connector according to claim 3, wherein said cam actuator includes means captivating said cam actuator between said arm and said housing.

5. An electrical connector according to claim 4, wherein said cam actuator includes a plate and said captivating means includes on said plate a pair of resiliently deflectable tines defining a slot therebetween.

6. An electrical connector according to claim 2, wherein said cam means on said actuator is movable between said cam surface and said web and wherein said spacer means on said actuator is movable between said web and said latch.

7. An electrical connector according to claim 1, wherein said electrical component to which said electrical connector is to be engaged includes a panel having an opening therein, said latch on said arm having a rearwardly facing shoulder that is adapted to freely reside in said opening when said cam actuator is in said first position and to engage said panel when said cam actuator is in said second position.

8. An electrical connector according to claim 1, wherein said electrical connector is hermaphroditic and includes a second said movable arm integrally supported on said housing and a second said cam actuator.

9. An electrical connector according to claim 8, wherein said electrical component to which said electrical connector is to be engaged includes a like hermaphroditic connector, and wherein said latch on said movable arm comprises a projecting member and the latch on said second movable arm comprises a complementary opening, said projecting members of connectors to be connected adapted to be disposed adjacent to the complementary openings when said cam actuuator is in said first position and to be in engagement with said latches in said openings when said cam actuator is in said second position.

10. In an electrical connector of the type having a housing and a plurality of electrical contacts therein, latching apparatus comprising:

an elongate member deflectably supported by a pivot on said housing, said member having a latch adjacent one end thereof, said latch being movable generally transversely of the longitudinal direction of said member; and an actuator captively supported for movment on said housing in said longitudinal direction, said actuator including thereon engaging means and a locking spacer spaced therefrom, said engaging means and said locking spacer being disposed on opposite sides of said pivot, said engaging means being responsive to said actuator movement for engaging said elongate member to thereby move said latch transversely relative to said housing and said locking spacer being responsive to the movement of said actuator for engaging said elongate member to thereby prevent movement of said elongate member except upon movement of said actuator.

11. The invention according to claim 10, wherein said pivot comprises a flexible web.

12. The invention according to claim 10, wherein said actuator is captivated on said housing for sliding movement in the longitudinal direction of said elongate member.

13. The invention according to claim 12, wherein said engaging means on said actuator includes a cam thereon and projecting therefrom.

14. The invention according to claim 13, wherein said elongate member includes a cam surface thereon for engagement with said cam.

15. The invention according to claim 14, wherein said cam surface is adjacent an end of said elongate member opposite said latch.

16. The invention according to claim 14, wherein said cam surface is adjacent said latch.

17. The invention according to claim 16, wherein said actuator includes a second spacer thereon, spaced from and on the same side of said pivot as said cam.

18. In an electrical connector of the type having a housing including a plurality of electrical contacts, said housing having a mating end for engagement with a second electrical connector, said second electrical connector including a latching portion for cooperative engagement with said mating end, latching apparatus comprising:

an arm movably supported on said housing, said arm including a latch adjacent one end thereof, said latch being disposed adjacent said housing mating end;

an actuator movably supported on said housing and operable between a first position and a second position, said actuator in said first position including means engaging said arm to dispose said latch at a first spacing relative to said housing mating end to facilitate non-locking interaction with said latching portion of said second electrical connector, said actuator in said second position including means engaging said arm to move said latch to a second spacing different from said first spacing relative to said housing mating end and for substantially preventing movement of said latch to facilitate locking interaction with said latching portion of said second electrical connector.

19. The invention according to claim 18, wherein said second spacing is greater than said first spacing.

20. The invention according to claim 18, wherein said arm is relatively rigid and is supported by pivotal movement on said housing.

21. The invention according to claim 20, wherein said arm is pivotally supported by a flexible web that spaces said arm a distance from said housing.

22. The invention according to claim 21, wherein said arm is disposed substantial parallel to said housing when said actuator is in said second position.

23. The invention according to claim 22, wherein said arm is disposed in an inclined position when said actuator is in said first position such that said arm end including said latch is sloping toward said housing.

24. The invention according to claim 18, wherein said actuator is slidably captivated on said housing.

25. The invention according to claim 24, wherein said means on said actuator disposing said latch to a first spacing comprises a cam for slidable engagement with a cam surface on said arm.

26. The invention according to claim 25, wherein said means on said actuator disposing said latch to said second spacing comprises a locking spacer, separated a distance from said cam.

27. The invention according to claim 18, wherein said latch comprises means for complementary engagement with a latch of a like electrical connector.

28. A method of engaging and disengaging an electrical connector with another electrical component, said connector being of the type having a movable latch for cooperative engagement with a portion of said component comprising the steps of:

placing said connector in juxtaposition with said component such that said latch is adjacent said component portion in non-latching relation; then moving an actuator movably supported on said electrical connector relative to said component, said actuator including means thereon responsive to said movement to move and hold said latch into a locking relation with said component portion; then oppositely moving said actuator relative to said component, said actuator including means thereon responsive to said opposite movement to move said latch away from said component portion and out from said locking relation therewith; and then removing said connector from juxtaposition with said component.

29. A method according to claim 28, wherein said electrical component to which said electrical connector is to be engaged and disengaged includes a panel having an opening therethrough, wherein said placing step includes inserting said movable latch freely into said opening and wherein said moving step moves said latch into engagement with said panel.

30. A method according to claim 28, wherein said electrical component to which said electrical connector is to be engaged and disengaged includes a like connector comprising complementary latching means, wherein said placing step includes disposing said latch and said complementary latching means in non-latching juxtaposition and wherein said moving step moves said latch into latching relation with said latching means.

31. A method according to claim 28, wherein said moving step is practiced by pushing said actuator toward said component and said oppositely moving step is practiced by pulling said actuator away from said component.

32. A method according to claim 28, wherein said moving step is practiced by pulling said actuator away from said component and said oppositely moving step is practiced by pushing said actuator toward said component.

* * * * *